United States Patent [19]

Goettl

[11] 4,406,585

[45] Sep. 27, 1983

[54] IMPELLER ASSEMBLY FOR A BLOWER MECHANISM

[75] Inventor: Adam D. Goettl, Phoenix, Ariz.

[73] Assignee: Goettl Enterprises, Phoenix, Ariz.

[21] Appl. No.: 275,317

[22] Filed: Jun. 19, 1981

[51] Int. Cl.[3] ..... F04D 29/28

[52] U.S. Cl. ..... 416/60; 416/184; 416/187

[58] Field of Search ..... 416/178, 187, 184, 199, 416/60, 214 R; 403/365, 366; 415/26, 87; 474/903, 179, 174; 180/DIG. 2; 301/128; 295/36 R, 39, 40; 248/188.5, 354 L

[56] References Cited

U.S. PATENT DOCUMENTS

| | | | |
|---|---|---|---|
| 265,196 | 9/1882 | Warner | 301/128 |
| 2,404,385 | 7/1946 | Fritts | 403/365 |
| 2,987,172 | 6/1961 | Linsenmeyer | 29/156.8 CF |
| 3,051,372 | 8/1962 | Rockafield et al. . | |
| 3,511,578 | 5/1970 | Norst . | |
| 3,702,741 | 11/1972 | Goettl . | |
| 3,738,591 | 6/1973 | Melluish | 403/365 |
| 3,746,464 | 7/1973 | Goettl | 415/201 |
| 4,199,302 | 4/1980 | Goettl . | |

*Primary Examiner*—Stephen Marcus
*Assistant Examiner*—Brian J. Bowman
*Attorney, Agent, or Firm*—Herbert E. Haynes, Jr.

[57] ABSTRACT

An impeller assembly for use in a blower structure including a blower wheel which defines a centrally located peripheral groove in which a special endless metallic pulley band is fixedly mounted and having a hub sleeve which is demountably carried on a tubular axle shaft which demountably carries a stub shaft in each of its opposite ends for rotatable journalling in the bearings of the blower structure.

22 Claims, 6 Drawing Figures

IMPELLER ASSEMBLY FOR A BLOWER MECHANISM

BACKGROUND OF THE INVENTION

1. Field of the Invention

This invention relates to gas moving mechanisms in general and more particularly to an impeller assembly for use in a blower mechanism.

2. Description of the Prior Art

Many structures have been devised for moving gaseous substances, such as air and other blowable materials, such as grain, with a specific type of such structure, commonly referred to as a centrifugal blower, being in wide spread use in, for example, central heating systems, central air conditioning systems, evaporative air cooling systems, and the like.

Although centrifugal blowers differ in structural details, they basically include a scroll-like shaped blower housing having an inlet opening formed in each of the opposite sidewalls thereof so as to be in axial alignment with each other, and having a centrifugal outlet opening. A bearing is carried centrally in each of the axial inlet openings on suitable struts and an axle Shaft is rotatably carried in those bearings. A blower wheel is mounted fast on the axle shaft for rotation therewith, with such an assembly constituting what is hereinafter referred to as an impeller assembly. Rotatable driving of the impeller assembly draws air, or other blowable material, into the blower housing through the axial inlets and discharges it under pressure through the centrifugal outlet.

Various means have been employed for rotatably driving the impeller assembly with the most common method being an electric motor mounted on the exterior of the blower housing, with a drive pulley carried on the motor's output shaft. A relatively large driven pulley is mounted fast on one end of the axle shaft and a V-shaped belt is employed to transmit rotary motion from the drive pulley to the driven pulley. Such a drive system places the driven pulley coaxial with one of the inlet openings of the blower housing immediately outwardly of that opening.

Such positioning of the driven axle pulley places its peripheral rim right in the high velocity flow path into the blower housing which results in a flow restricting turbulence, and in many instances, the belts which drive the pulleys will deteriorate rather rapidly due to the damaging effects of the inlet flow to the blower housing. Also, drive pulleys employed in this manner are relatively expensive.

To overcome these problems, several attempts have been made to fabricate a blower wheel with a pulley formed integrally on the periphery of the wheel itself. This concept has several advantages over the above described separate drive pulley carried on the axle shaft, such as relocation of the drive belt so that it is no longer directly subjected to the deteriorating effects of the blower materials moving into the blower housing. By using a driven pulley which is integral with the blower wheel, the flow restricting turbulence of the separate pulley mounted in the inlet opening of the blower housing is, of course, completely eliminated.

Among the most important advantages of an impeller assembly having a pulley on the periphery of the blower wheel, is that such a pulley is equal, or at least very close, in diameter to the blower wheel, and thus is considerably larger, in most cases, than the practical size limitations of the separate axle mounted pulley. The larger diameter of the pulley provided on the periphery of the blower wheel allows the use of a higher speed motor which inherently runs cooler and is less expensive than slower running motors.

This integral pulley/blower wheel concept has not, however, been commercially accepted due to the necessity of changing the traditional methods of fabricating blower wheels, tooling costs and the like.

A particular prior art patent disclosing a pulley structure as being demountably attached to the periphery of a blower wheel was issued on Nov. 14, 1972, as U.S. Pat. No. 3,702,741, to Adam D. Goettl. Briefly, this patent discloses an especially molded, or otherwise formed, elongated strip of resilient material which is configured with a V-shaped groove extending along its top surface, and a wheel rim gripping formed on each of its opposite sides. The strip is cut to the desired length and its opposite ends brought into abutting engagement to form the strip into a hoop-like pulley structure. In a first embodiment, the hoop-like pulley is placed between juxtaposed rims of a pair of blower wheels which are mounted in a coaxial side-by-side relationship on the axle shaft. In this embodiment the hoop-like pulley is held in this position by the clamping effect of the juxtaposed wheels and by a plurality of radially disposed clip fasteners which hold the wheel rims in the proper clamping position. In a second embodiment, the hoop-like pulley is placed so that one side edge thereof is in engagement with the rim of a single blower wheel. An endless support ring is positioned on the other side edge of the hoop-like pulley, and a plurality of radially disposed bolts are employed to secure the support ring and the hoop-like pulley structure to the rim of the blower wheel.

Like the hereinbefore discussed integral pulley/-blower wheel structure, the demountable pulley/-blower wheel configuration suggested by the hereinbefore referenced U.S. patent has not achieved commercial acceptance. Although converting from the existing separate axle mounted pulley technology to the demountable hoop-like pulley would not be as difficult and as expensive as converting to the integral pulley concept, the cost for the tooling involved in fabricating the special elongated resilient strips used to form the demountable hoop-like pulley is quite high. This tooling cost in conjunction with assembly time has made industry reluctant to change from its long used technology.

In addition to this cost related drawback, the material of which the demountable pulley was made needed to be resilient to allow it to be shaped into the desired hoop-like configuration and to allow it to conform to the blower wheel rim, or rims. This resilient material, while being beneficial in those respects, has some drawbacks. First, such material is deflectable and the forces exerted thereon by the drive belt tend to deform it by spreading the sides of the V-shaped groove and the like. Secondly, the wear characteristics of such material is questionable and thirdly, it is virtually impossible to hold the abutting ends in a smooth curved configuration and this results in high wear point.

In addition to the above, another problem exists which relates to impeller assemblies, that is, the blower wheels and the axle shafts upon which they are carried. In many cases, the blowable materials moved by centrifugal blowers presents a hostile environment, which significantly shortens the useful life of the centrifugal blowers per se, and oftentimes necessitates premature component replacement.

An outstanding example of this exists in the centrifugal blowers utilized in evaporative air cooling systems. The air handled by the centrifugal blowers in such systems is heavily ladened with free moisture, i.e., that which is not evaporated into the air. This, of course, is condusive to rust and corrosion. In most cases, the moisture is added to the air from a water supply having a high mineral salt content and this contributes significantly to the rust and corrosion problems.

For this reason, the blower wheels and the axle shafts of centrifugal blowers used in evaporative air cooling devices are among the components which are plagued by premature failures.

What occurs is that the blower wheels become rusted fast on the axle shafts and when this happens, it becomes extremely difficult, and sometimes impossible, to remove those components from the blower housing. The need for such removal arises for example, when badly rusted axle shafts and damaged bearings need to be replaced, and in many instances, a reusable blower wheel will be damaged during such removal.

Therefore, a need exists for a new and improved impeller assembly which overcomes some of the problems and shortcomings of the prior art.

SUMMARY OF THE INVENTION

In accordance with the present invention, a new and improved impeller assembly is disclosed as including a blower wheel assembly having a special peripherally disposed endless pulley thereon and having means for mounting the blower wheel assembly on a special axle shaft assembly.

The special blower wheel assembly is actually formed in a preferred embodiment of two blower wheels which are preferrably of the type commonly referred to as cantilever blower wheels. The two cantilever blower wheels will hereinafter be considered as being identical structures, but it will be understood that they may be different in so far as their structural details are concerned. For example, cantilever blower wheels having different axial lengths may be used. In any event, the two cantilever blower wheels each includes a single substantially disc-shaped end plate from the periphery of which a plurality of blower wheel blades extend in cantilever fashion. The two cantilever blower wheels are disposed in a back-to-back position with a spacer means therebetween, so that their end plates are juxtaposed and are bolted or otherwise interconnected adjacent their peripheries to form the center suspended blower wheel which rotates as a single entity.

The end plates of the two cantilever blower wheels are of special configuration so that when interconnected in the above described manner, they cooperatively define an endless annular groove which opens onto the periphery of the center suspended blower wheel. A special endless pulley is captively retained within the annular groove, and the pulley is in the form of a metallic band, the opposite ends of which are in abutting engagement with each other and are welded, so that the metal band is of endless configuration. Subsequent to fabrication of the metal band into the endless configuration, it is rolled, or otherwise formed to provide a special transverse cross sectional configuration therein which serves to control positioning of the belt, or belts which rotatably drive the impeller assembly. In the preferred embodiment, the special cross sectional configuration is of arcuate, or crown, shape which causes the drive belt, or belts to ride up and stay on the high point of the crown.

In addition to the bolts which attach the end plates of the two cantilever blower wheels together, the end plates each have a flanged hole formed centrally therein, and a tubular hub sleeve is disposed and welded, or otherwise, attached so as to pass through and extend oppositely beyond the aligned flanged holes of the two end plates. This fixedly attached hub sleeve, in conjunction with the bolts, rigidly and fixedly interconnect the two cantilever blower wheels so that they cannot become separated, i.e., move axially away from each other, due to vibrations, or other workings thereof. In this manner, the two cantilever blower wheels form an exceptionally strong center suspended blower wheel which captively holds the endless metallic pulley band in a fixed position.

The above described center suspended blower wheel overcomes some of the problems inherent in the prior art driving of such structures with axle mounted pulleys. Namely, the drive belt, or belts, are relocated so that they are no longer in direct contact with the deteriorating effects of the inlet to the blower housing, the drive pulley is positioned so that it will not interfere with the inflow to the blower housing and it inherently allows the use of cooler running, lower cost, high speed motors.

In addition to these advantages, the center suspended blower wheel of the present invention provides advantages over the prior art pulleys which are peripherally disposed on the blower wheel. Namely; the tooling costs are relatively low, changes in the traditional manufacturing techniques are minimized and the inherent structural rigidity of the endless metallic pulley band makes it virtually impervious to the distortion forces applied thereto by the drive belt, or belts. Another advantage has been found which results from the diameter of the endless metallic pulley band which is equal in size, or at least nearly so, to the diameter of the blower wheel. With such a diameter, the increased contact area of the drive belt(s) with the endless metallic pulley band provides sufficient frictional engagement therebetween so that the V-shaped groove heretofore considered essential in all pulley structures can be done away with.

The extending opposite ends of the hub sleeve are each provided with a plurality of radially disposed longitudinal slots, which allow those ends to be circumferentially compressed into frictional gripping engagement with the special axle shaft assembly of the impeller assembly by suitable clamp means. Although the center suspended blower wheel is preferrably configured in this manner so as to demountably carried on the special axle shaft assembly, the blower wheel may be fixedly attached such as by welding the hub sleeve thereon.

The axle shaft assembly includes an elongated tubular shaft conduit which, similar to the hub sleeve, has its opposite ends formed with radially disposed longitudinally extending slots to allow circumferential compression thereof. The opposite ends of the tubular shaft conduit are demountably connected, by means of suitable clamps, to stub shafts which extend oppositely from the shaft condhit for rotatable journalling in the bearings provided in each of the axial air inlet openings of the centrifugal blower housing.

The bore of the hub sleeve is sized so that it is a loose fit on the periphery of the axle shaft conduit, and the bore of the axle shaft conduit is sized so that it is a loose fit on the periphery of the stub shafts. This inhibits corrosion induced freezing of those components so that when the clamps are loosened, axial sliding disassembly thereof is facilitated. In addition to this, the hub sleeve and the axle shaft conduit are preferrably formed of galvanized tubing which, in addition to being relatively inexpensive, is a highly corrosion resistant material.

An alternate embodiment of the impeller assembly of the present invention, which may be desirably employed in some instances, completely does away with the tubular shaft conduit of the axle assembly by utilizing a hub sleeve which is axially elongated to allow it to serve the additional function of the shaft conduit.

Accordingly, it is an object of the present invention to provide a new and improved impeller assembly for use in a blower mechanism.

Another object of the present invention is to provide a new and improved impeller assembly for use in a blower mechanism which includes a center suspended blower wheel which is configured to fixedly support a special and peripherally disposed endless pulley band.

Another object of the present invention is to provide a new and improved impeller assembly of the above described character wherein the center suspended blower wheel defines an annular groove which opens upwardly onto the periphery of the blower wheel and is configured to provide means for fixedly holding the special endless pulley band.

Another object of the present invention is to provide a new and improved impeller assembly of the above described character wherein the pulley band is in the form of an endless metallic band which, in conjunction with the manner in which it is held by the center suspended blower wheel, results in the pulley band being impervious to the distortive forces applied thereto by the belts which rotatably drive the impeller assembly.

Another object of the present invention is to provide a new and improved impeller assembly of the above described character wherein the endless metallic pulley band is formed with a special cross sectional configuration for controlling the position of the drive belt, or belts.

Another object of the present invention is to provide a new and improved impeller assembly of the above described character wherein the center suspended blower wheel is provided with a fixedly attached hub sleeve which improves the structural integrity thereof and provides means for mounting the center suspended blower wheel on a special axle shaft assembly.

Another object of the present invention is to provide a new and improved impeller assembly of the above described character wherein the hub sleeve of the center suspended blower wheel is a loose axially slidable fit on the periphery of the axle shaft assembly to inhibit corrosion induced freezing of the center suspended blower wheel on the axle shaft assembly, with the opposite ends of the hub sleeve being circumferentially compressable to allow clamped frictional mounting thereof on the axle shaft assembly.

Another object of the present invention is to provide a new and improved impeller assembly of the above described type wherein the axle shaft assembly includes an elongated tubular shaft conduit the opposite ends of which are circumferentially compressable to allow frictional and demountable attachment thereof to stub shafts which provide means by which the impeller assembly is rotatably supported.

Still another object of the present invention is to provide a new and improved impeller assembly of the above described character wherein the hub sleeve of the center suspended blower wheel and the shaft conduit of the axle assembly are formed of corrosion resistant tubular material.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
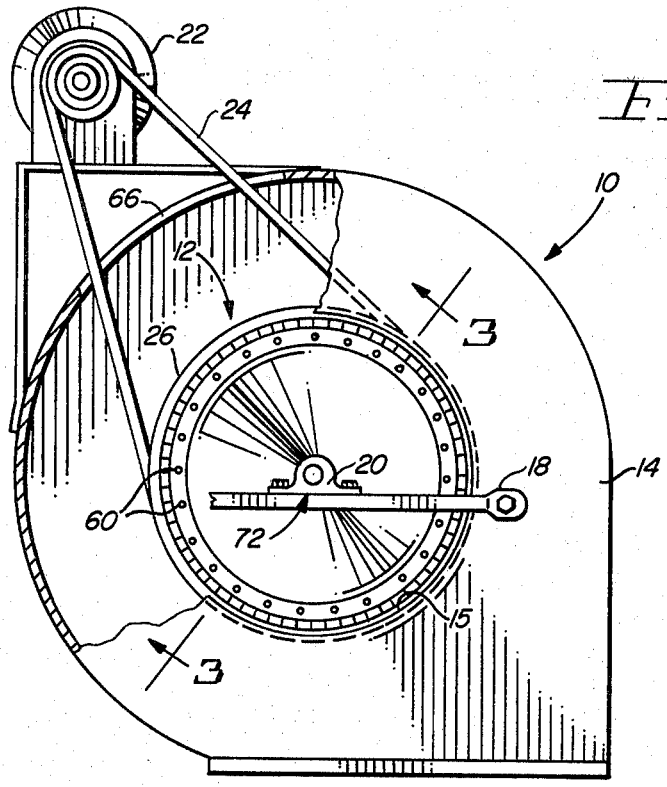
FIG. 1 is a side elevational view of the centrifugal blower assembly which is partially broken away to show the various features of the impeller assembly of the present invention which is mounted therein.

Referring more particularly to the drawings, FIG. 1 illustrates a centrifugal blower which is indicated in its entirety by the reference numeral 10. This basic type of centrifugal blower is in common usage throughout, for example, the air conditioning field. As will hereinafter be described, the centrifugal blower 10 is provided with the impeller assembly of the present invention, and which is especially designed to withstand hostile environments to which it may be subjected when used, for example, in an evaporative air cooler (not shown).

Before proceeding with the detailed description of the impeller assembly 12 of the present invention, a brief description of the centrifugal blower 10 will be given to insure a complete understanding of the invention.

The centrifugal blower 10 includes a blower housing 14 which is of a scroll-like configuration having a pair of opposed inlets 15 (one shown) formed in the opposite sides thereof and disposed to be in axial alignment with each other, and having a centrifugal outlet 16. A pair of cross member means 18 (one shown) are suitably attached to each of the opposite sides of the blower housing 14 and are disposed to span th inlets 15 formed in their respective sides of the housing. Each of the cross member means 18 are provided to carry a bearing means 20 so that those bearing means lie on the axis defined by the aligned inlets 15. The impeller assembly 12 is supported and journalled for rotation between the inlets 15 of the blower housing 14 in the bearing means 20, as is customary in the art, and a suitable motor 22 mounted on the blower housing 14 is employed to rotatably drive the impeller assembly by means of a belt, or belts 24. Rotational driving of the impeller assembly 12 results in a negative static pressure within the housing 14 which draws blowable material, air in most cases, into the housing through the axial inlets 15 and expels the blowable materials under pressure from the housing through the centrifugal outlet 16.

The impeller assembly 12 of the present invention includes a special blower wheel 26 which is preferrably of the type commonly referred to as a center suspended blower wheel. As seen best in FIG. 2, the center suspended blower wheel 26 is actually an assembly formed of two cantilever blower wheels 28 and 30, which are interconnected in a back-to-back relationship as will be hereinafter described.

The two cantilever blower wheels 28 and 30 may differ from each other with respect to some of the structural details thereof. For example, blade configuration and the like. For illustrative and descriptive purposes, the two cantilever blower wheels 28 and 30 are shown as identical structures, and in fact they may differ from each other with regard to their axial lengths. However, the following description of the blower wheel 28 will be understood to also apply to the other wheel 30.

The cantilever blower wheel 28 is provided with a single substantially disc-shaped end plate 32 which is provided with a conical hub portion 34 with a centrally located flanged hole 36 formed therein for reasons which will become apparent as this description progresses. The conical hub portion 34 of the end plate 32 terminates in an endless integral ring-shaped flat portion 38 which is bent as at 39 to provide an integral endless peripheral ring 40 which is axially offset with respect to the ring-shaped flat portion 38. The endless peripheral ring 40 has its extending edge 42 rolled in the manner shown to grippingly hold one end of a plurality of blades 44 so that those blades extend from the peripheral ring 40 of the end plate 32 in a cantilever fashion. An endless annular ring 46 is rolled as at 47 in a manner similar to the peripheral ring 40 of the end plate 32 to grippingly hold the extending ends of the plurality of blades 44. The blades extend between the peripheral ring 40 of the end plate 32 and the annular ring 46 and are positioned in spaced intervals to form a cylindrical configuration which is concentric with the flanged hole 36 of the end plate 32.

Each of the blades 44 are formed with a pair of tabs 48, one on each of the opposite ends of the blades. Blades fabricated in the illustrated, or similar manner are assembled by inserting portions of the tabs 48 within the rolled edges 42 and 47 respectively of the peripheral ring 40 and the annular ring 46, prior to final closing of those rings.

As hereinbefore mentioned, the center suspended blower wheel 26 includes the two cantilever blower wheels 28 and 30 which are interconnected in a back-to-back relationship. As seen best in FIG. 3, a hub sleeve 50 is passed through the axially aligned flanged center holes 36 of the two cantilever wheels 28 and 30 and is affixed therein, such as by welding. The hub sleeve 50 is sized as to its length so that the opposite ends 52 thereof extend oppositely beyond the flanged holes 36 and those ends 52 are each formed with a plurality of radially disposed longitudinally extending slots 53 which allow those ends to be circumferentially compressed as will hereinafter be described in detail.

Figure 2:
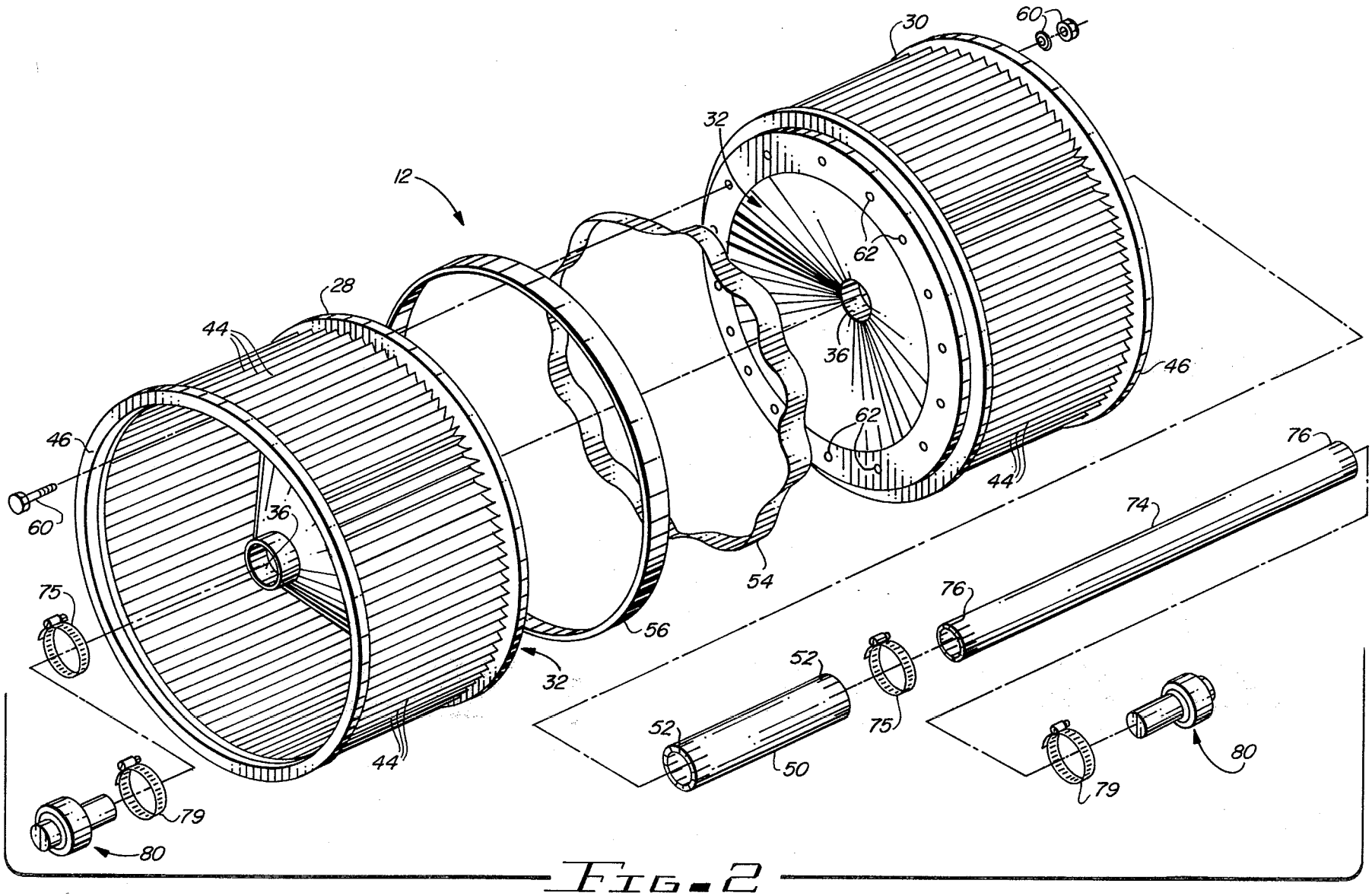
FIG. 2 is an exploded perspective view of the impeller assembly of the present invention.

Prior to welding, or otherwise affixing the hub sleeve 50, a spacer means 54 is poisitoned between the back-to-back end plates 32 of the cantilever blower wheels 28 and 30 so as to lie between the juxtaposed ring-shaped flat portions 38 of the wheels. The spacer means 54, which is preferrably an endless band of undulating configuration, as seen best in FIGS. 2 and 4, is employed, in conjunction with the hub sleeve 50 to determine the space between the blower wheels 28 and 30 and fix those blower wheels with that predetermined spaced relationship.

In addition to installing the spacer means 54 between the blower wheels 28 and 30, prior to affixation of the hub sleeve 50, an endless metallic pulley band 56, which will hereinafter be described in detail, is inserted between the blower wheels so that it is disposed between the axially offset peripheral rings 40 of the blower wheels which cooperatively define an endless annular groove 58 which opens onto the periphery of the center suspended blower wheel 26 between the two cantilever blower wheels 28 and 30 thereof.

With the spacer means 54 and the metallic pulley band 56 positioned between the end plates 32 of the two cantilever blower wheels 28 and 30, the hub sleeve 50 is affixed as described above and a plurality of fastener means 60 are employed at rigidly interconnect the end plates together adjacent their peripheries. The end plates 32 of the cantilever blower wheels 28 and 30 are each formed with a plurality of holes 62 which are provided in spaced increments in the endless ring-shaped flat portions 38 thereof, and the fastener means 60, in the preferred form of suitable bolts, washers and nuts, are passed through the aligned holes 62 of the end plates 32 to hold them in rigid positions with respect to each other.

Figure 4:
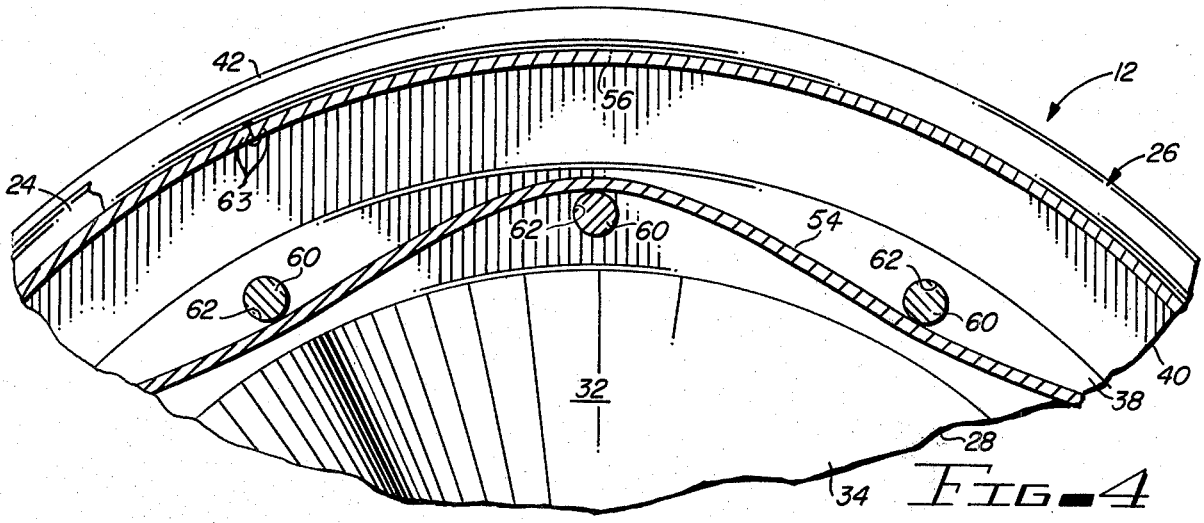
FIG. 4 is an enlarged fragmentary sectional view taken along the line 4—4 of FIG. 3.

As seen best in FIG. 4, the spacer means 54 in the preferred undulating endless band configuration is disposed to alternately pass under and over adjacent ones of the fastener bolts 60 which fixes the undulating spacer band 54 against displacement.

The endless metallic pulley band 56 is formed of a metal strap which is positioned with its opposite ends 63 (FIG. 4) in abutting engagement with each other to form the endless pulley band 56, and those opposite ends are affixed to each other such as by the well known butt welding technique. Subsequent such formation of the metallic strap into the endless pulley band 56, the strap is formed, such as by rolling, into an arcuate cross sectional configuration as shown at 64 in FIG. 3. This arcuate or crown-shaped outwardly extending cross sectional configuration 64 serves two functions. First, it prevents the endless pulley band 56 from being displaced as a result of the forces applied by the drive belts 24, in that the arcuate width of the metal pulley band 56 is greater than the distance between the peripheral rings of the end plates 32, so that the opposite edges of the pulley band 56 are in bearing engagement with the spaced apart peripheral rings 40. Thus, the forces applied by the drive belts 24 will tend to straighten out the transverse crown 64 of the pulley band 56 and this cannot be accomplished due to the inherent strength of the metal band and due to the fastener means 60 which resists spreading of the peripheral rings 40 of the end plates 32. Secondly, the outwardly extending transverse crown 64 will cause the drive belts 24 to ride up on top of the crown 64, as shown in FIG. 3, so that the only point of frictional engagement is between the inside surfaces of the belts and the outer peripheral surface of the crown shaped metal pulley band 56.

The endless metallic pulley band 56 lends itself well to being fabricated in various sizes, in that by cutting the metal strap to the desired length prior to forming it into its endless configuration, the pulley band 56 can be easily modified to fit blower wheels of various diameters. Further, by cutting the metal strap in various widths, it can be easily made to accomodate various numbers of drive belts.

Figure 3:
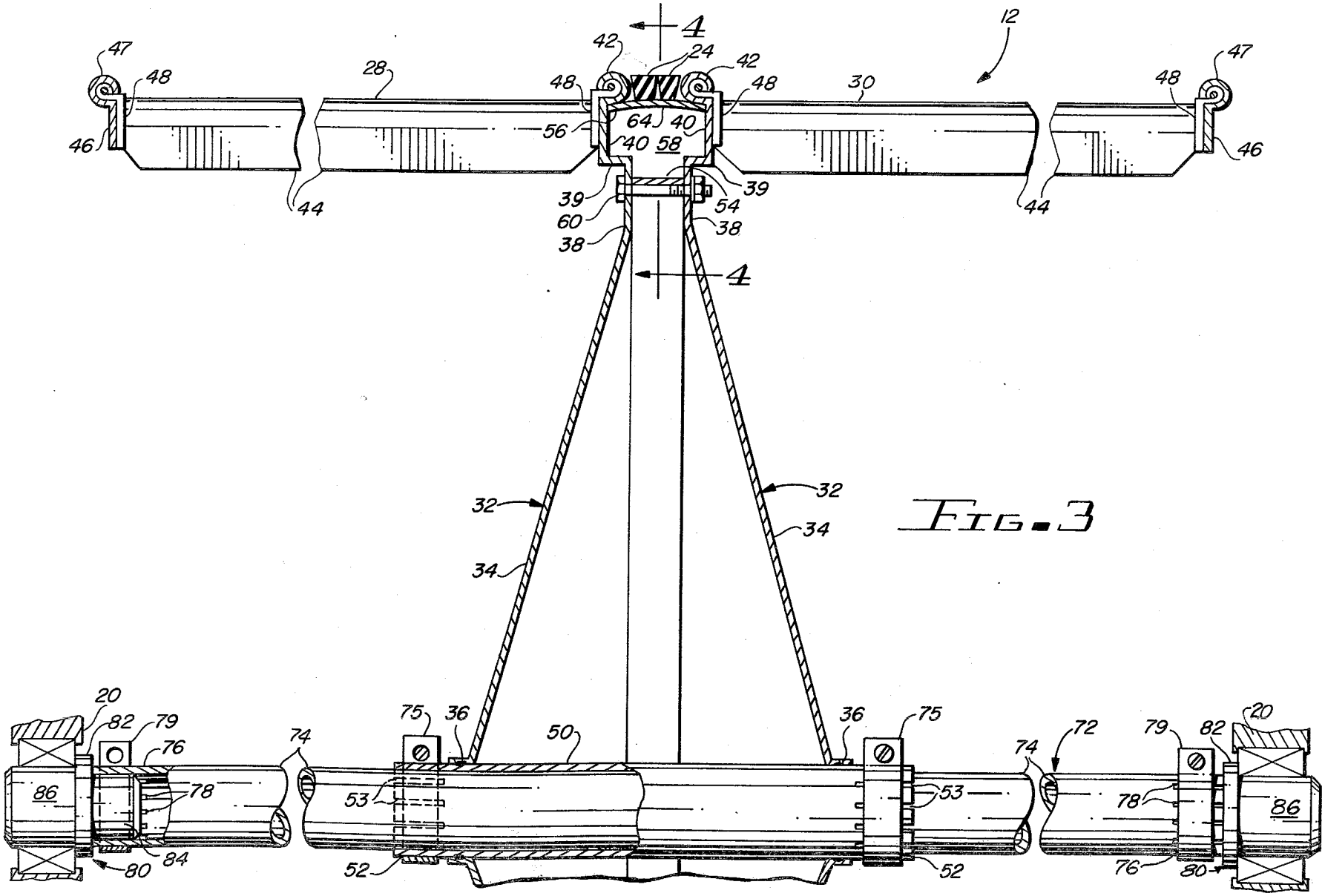
FIG. 3 is an enlarged fragmentary sectional view of the impeller assembly of the present invention.

It will be noted in FIG. 3, that the endless metallic pulley band 56 is sized as to its diameter so that it is located adjacent the peripheral opening of the annular groove 58. In this manner, the diameter of the metallic pulley band is approximately the same size as the diameter of the center suspended blower wheel 26. With the pulley band being sized in this manner, the size of the drive motor 22, FIG. 1, may be reduced in comparison to prior art drive motors. In other words, a relatively small and less expensive high speed motor may be used. However, in the event that it is desired to use an endless metallic pulley band of smaller diameter, this may be easily accomplished by simply fabricating the pulley band 56 with a smaller diameter so that it is disposed in the bottom of the annular groove 58 as shown in FIG. 5.

Figure 5:
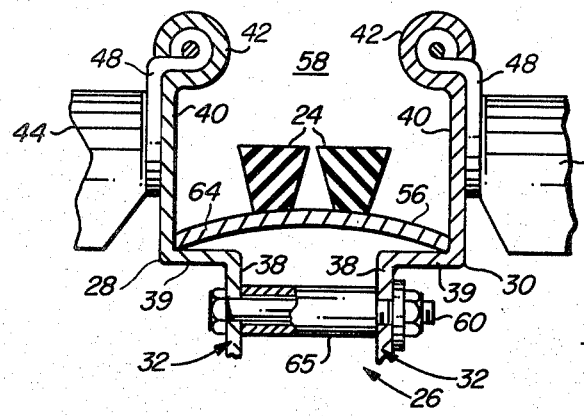
FIG. 5 is a fragmentary sectional view illustrating a modification of the impeller assembly of the present invention.

FIG. 5 also shows a modification of the blower wheel 26 wherein the spacer means is in the form of spacer sleeves 65 (one shown). The spacer sleeves 65 are used in the well known manner by slidingly mounting them on the shanks of each of the bolts of the fastener means 60 so that they will maintain the desired spacing between the end plates 32 of the cantilever blower wheels 28 and 30.

With the center suspended blower wheel 26 fabricated as described above with the centrally located metallic pulley band 56, the centrifugal blower housing 14, FIG. 1, is provided with a suitable opening 66 through which the drive belts 24 pass to transmit rotary motion from the motor 22 to the impeller 12.

In addition to the especially configured center suspended blower wheel 26, the impeller assembly 12 of the present invention also includes a special axle shaft assembly 72 upon which the wheel 26 is demountably carried in the manner whereby they rotate as a single entity.

The axle shaft assembly 72 includes an enlongated tubular axle shaft 74 having an outside diameter which is smaller than the inside diameter of the hub sleeve 50 whereby the axle shaft 74 will freely slide in the bore of the hub sleeve.

As hereinbefore mentioned, the opposite ends 52 of the hub sleeve 50 are circumferentially compressable by virtue of the radial slots 53 formed therein. Thus, the tubular axle shaft 74 will slide axially and freely in the bore of the hub sleeve 50, and suitable clamps 75 are employed to circumferentially compress the ends 52 of the hub sleeve 50 into frictional gripping engagement with the axle shaft 74. This particular mounting arrangement is employed to eliminate, or at least substantially reduce, the occurrence of the blower wheel becoming fixedly attached to the axle shaft due to moisture induced corrosion. The relatively loose fit of the axle shaft 74 within the hub sleeve 50 is responsible for this deterrence of corrosion induced affixation, and this may be further enhanced by employing corrosion resistant materials for fabricating both the hub sleeve 50 and the tubular axle shaft 74. For example, galvanized tubing is well suited for the purpose and additionally, galvanized tubing is relatively inexpensive and readily available.

The elongated tubular axle shaft 74 is mounted, in the hereinbefore described manner, so that its opposite ends 76 extends equal distances from the center suspended blower wheel 26, and those opposite ends 76 are each provided with a plurality of radially disposed longitudinally extending slots 78. Thus, the opposite ends 76 of the tubular axle shaft 74 are circumferentially compressable in the same manner as the hub sleeve 50, and this allows each of the opposite ends of the axle shaft 74 to be circumferentially compressed by suitable clamps 79 into frictional gripping engagement with different ones of a pair of stub shafts 80, and this deters corrosion induced affixation of the axle shaft 74 to the stub shafts 80 in the hereinbefore described manner.

The stub shafts 80 are each formed with an annular shoulder 82 from which a boss 84 axially extends for sliding into the bore of the tubular axle shaft 74, and from which a trunnion 86 extends axially and oppositely for engagement with the bearings 20 of the blower housing as seen best in FIG. 3.

Although the above described demountable mounting of the center suspended blower wheel 26 on the axle shaft assembly 72 is preferred, the tubular axle shaft 74 may be welded or otherwise fixedly mounted in the hub sleeve 50 of the blower wheel assembly 26 without hampering the ease by which the impeller assembly can be removed from the blower housing 10, in that the demountable stub shafts 80 will provide this ease of assembly by themselves.

Figure 6:
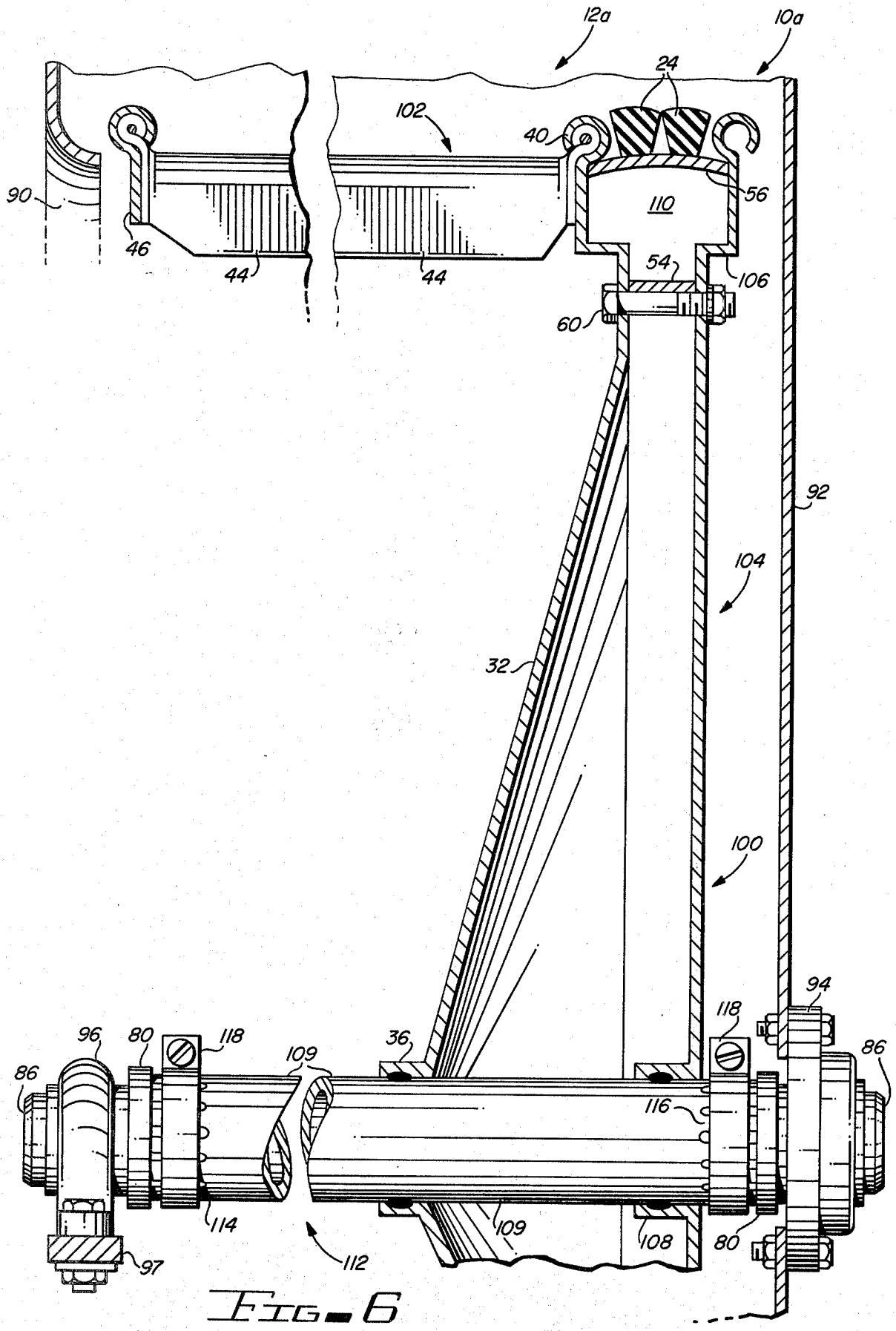
FIG. 6 is a fragmentary sectional view similar to FIG. 3 and showign a modified form of the impeller assembly of the present invention.

Referring now to FIG. 6 wherein a modification of the impeller assembly **12*a* of the present invention is shown, with this embodiment being suited for use in a different type of blower housing 10*a***.

The blower housing **10*a* is similar to the hereinbefore described housing 10 with the exception that it is formed with a single inlet 90 through which blowable materials enter the housing 10*a*. The opposite sidewall 92 thereof is closed and a suitable bearing means 94 is carried on that sidewall so as to be in axial alignment with the bearing 96 carried on the cross member 97 centrally in the inlet 90. The modified impeller assembly 12*a* is rotatably journalled in the bearings 94 and 96 and is thus disposed in axial alignment with the single inlet 90 of the housing 10*a***.

The modified impeller assembly **12*a* includes a blower wheel assembly 100 formed of a single cantilever blower wheel 102 to which a disc-plate 104** is mounted as will hereinafter be described.

The cantilever blower wheel 102 is the same as the hereinbefore described blower wheel 28 or 30 and thus includes the end plate 32 having the axially offset peripheral ring 40 and the centrally located flanged hole 36. The disc-plate 104 is provided with an oppositely axially offset peripheral ring 106 and a centrally located flanged hole 108. The disc-plate 104 is fixedly attached to the end plate 32 of the cantilever blower wheel 102 by the hub sleeve 109 which is similar to the hereinbefore described hub sleeve 50 except for its axial length as will be described. The hub sleeve 109 is disposd so that it extends axially through the flanged holes 36 and 108 of the blower wheel 102 and the disc-plate 104, respectively and is welded or otherwise fixed therein. The spacer means 54 and fastener means 60 are employed in the same manner as in the blower wheel assembly 26. Therefore, the cantilever blower wheel 102 and the disc-plate 104 cooperatively define an annular groove 110 for fixed containment of the endless metallic pulley band 56.

The blower wheel assembly 100 is shown as being mounted on a modified form of axle assembly 112, but it should be understood that the previously described axle shaft assembly 72 could be used.

As hereinbefore mentioned, the hub sleeve 109 differs from that previously described with regard to its axial length which is extended so that it may additionally accomplish the function of the previously described tubular axle shaft 74. The opposite circumferentially compressable ends 114 and 116 of the hub sleeve 109 are adapted to demountably carry the stub shafts 80 which are frictionally held therein by means of suitable clamps 118.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An impeller assembly for use in a blower structure of the type having a bearing mounted centrally in each of the axially aligned inlet openings thereof, said impeller assembly comprising:

(a) a pair of blower wheels each having at least one end plate, each of the end plates having a centrally disposed hole and an endless axially offset peripheral ring;

(b) a hub sleeve mounted in the center holes of the end plates of said pair of blower wheels for interconnection thereof in an axially aligned juxtaposed relationship with the axially offset peripheral rings of the end plates of said pair of blower wheels comparatively defining an endless annular groove;

(c) an endless pulley band formed of a metallic strip in the endless annular groove defined by the axially offset peripheral rings of the end plates of said pair of blower wheels, said pulley band having its opposite side edges in bearing engagement with the peripheral rings of the end plates of said pair of blower wheels to fixedly hold said pulley band therebetween; and (d) axle shaft means in said hub sleeve for rotation with said pair of blower wheels, said axle shaft means having its opposite ends disposed for rotatable journalling in the bearings of the blower structure.

2. An impeller assembly as claimed in claim 1 and further comprising:

(a) said hub sleeve fixedly mounted in the central holes of said end plates of said pair of blower wheels to fixedly interconnect those end plates in a predetermined spaced apart relationship;

(b) spacer means interposed between the end plates of said pair of blower wheels adjacent the endless peripheral rings thereof to prevent the peripheral rings of said end plates from moving toward each other and thereby maintain the desired spaced relationship at the periphery of the end plates of said pair of blower wheels; and (c) fastener means passing through the end plates of said pair of blower wheels adjacent said spacer means to fixedly interconnect those end plates adjacent the peripheral rings thereof.

3. An impeller assembly as claimed in claim 2 wherein said spacer means comprises an endless band.

4. An impeller assembly as claimed in claim 2 wherein said spacer means comprises an endless band of undulating configuration.

5. An impeller assembly as claimed in claim 2 wherein said fastener means comprises a plurality of bolts which are arranged in radially disposed increments.

6. An impeller assembly as claimed in claim 1 wherein said endless metallic pulley band is formed with an arcuate outwardly extending cross sectional configuration.

7. An impeller assembly as claimed in claim 1 wherein said hub sleeve is formed of corrosion resistant tubing.

8. An impeller assembly as claimed in claim 1 wherein said axle shaft means comprises:

(a) said hub sleeve being an axially elongated tubular member the opposite ends of which have means formed therein which allow those opposite ends to be circumferentially compressed;

(b) a pair of stub shafts each having a boss axially extending therefrom for free sliding insertion into the bore of said hub sleeve at different ones of the opposite ends thereof;

(c) clamp means on each of the opposite ends of said hub sleeve for exerting circumferentially compressive forces thereon by which the opposite ends of said hub sleeve are in frictional gripping engagement with the bosses of different ones of said pair of stub shafts; and (d) said pair of stub shafts each having an oppositely axially extending trunnion for rotatable journalling in the bearings of the blower housing.

9. An impeller assembly as claimed in claim 1 wherein the internal diameter of said hub sleeve is greater than the external diameter of said axle shaft means for free axial sliding movement thereon and each of the opposite ends of said hub sleeve is provided with means for allowing the opposite ends of said hub sleeve to be circumferentially compressed into frictional gripping engagement with said axle shaft means.

10. An impeller assembly as claimed in claim 9 wherein said means formed in each of the opposite ends of said hub sleeve by which those ends may be circumferentially compressed includes a plurality of radially disposed longitudinally extending slots.

11. An impeller assembly as claimed in claim 9 and further comprising clamp means on each of the opposite ends of said hub sleeve by which those opposite ends are circumferentially compressed into frictional engagement with said axle shaft means.

12. An impeller assembly as claimed in claim 1 wherein said axle shaft means comprises:

(a) an elongated tubular axle shaft the opposite ends of which have means formed therein which allow those opposite ends to be circumferentially compressed;

(b) a pair of stub shafts each having an axially extending boss for free sliding insertion into the bore of said tubular axle shaft at different ones of the opposite ends thereof;

(c) clamp means on each of the opposite ends of said tubular axle shaft for exerting circumferentially compressive forces thereon by which the opposite ends of said tubular axle shaft are in frictional gripping engagement with the bosses of different ones of said pair of stub shafts; and (d) each of said pair of stub shafts having an oppositely axially extending trunnion for rotatable journalling in the bearings of the blower structure.

13. An impeller assembly as claimed in claim 12 wherein said elongated tubular axle shaft is formed of corrosion resistant tubing.

14. An impeller assembly for use in a blower structure of the type having a spaced pair of bearings disposed in axial alignment with at least one inlet opening formed in the blower housing, said impeller assembly comprising:

(a) blower wheel means having an axially elongated hub sleeve fixedly carried so as to extend axially and centrally therefrom, the opposite ends of said hub sleeve having means formed therein which allow those ends to be circumferentially compressed, said blower wheel means including, I. a blower wheel having at least one end plate in which a centrally disposed hole and an endless axially offset peripheral ring are formed, II. a disc-plate in which a centrally disposed hole and an axially offset peripheral ring are formed, III. said hub sleeve mounted in the central holes of said blower wheel and said disc-plate for interconnection thereof in axially aligned juxtaposed relationship with the axially offset peripheral rings of said blower wheel and said disc-plate cooperatively defining an endless annular groove, IV. an endless pulley band formed of a metallic strip in the endless annular groove defined by the axially offset peripheral rings of said blower wheel and said disc-plate, said pulley band having its opposite side edges in bearing engagement with the peripheral rings of said blower wheel and said disc-plate to fixedly hold said pulley band therebetween;

(b) a pair of stub shafts each having a boss extending axially therefrom for free sliding insertion into the bore of said hub sleeve at different ones of the opposite ends thereof;

(c) clamp means on each of the opposite ends of said hub sleeve for exerting circumferentially compressive forces thereoon by which the opposite ends of said hub sleeve are in frictional gripping engagement with the bosses of different ones of said pair of stub shafts; and (d) said pair of stub shafts each having an oppositely axially extending trunnion for rotatable journalling in the bearings of the blower housing.

15. An impeller assembly as claimed in claim 14 and further comprising:

(a) said hub sleeve of said blower wheel mounted in the central holes of said blower wheel and said disc-plate for fixed interconnection thereof in a predetermined spaced apart relationship;

(b) spacer means interposed between said blower wheel and said disc-plate adjacent the endless axially offset peripheral rings thereof to maintain the desired predetermined spaced relationship of said blower wheel and said disc-plate at the peripheries thereof; and (c) fastener means passing through the end plate of said blower wheel and through said disc-plate adjacent said spacer means to fixedly interconnect said blower wheel and said disc-plate adjacent the peripheral rings thereof.

16. An impeller assembly as claimed in claim 14 wherein said endless metallic pulley band is formed with an arcuately outwardly extending cross sectional configuration.

17. An impeller assembly for use in a blower structure of the type having a spaced pair of bearings disposed in axial alignment with at least one inlet opening formed in the blower housing, said impeller means comprising:

(a) blower wheel means having an axial hub with a bore formed therethrough;

(b) an elongated tubular axle shaft in the bore of the hub of said blower wheel means for rotation therewith, said tubular axle shaft having a plurality of radially disposed longitudinally extending slots formed on each of its opposite ends which allows those opposite ends to be circumferentially compressed (c) a pair of stub shafts each having an axially extending boss freely slidably carried in a different one of the opposite ends of said tubular axle shaft;

(d) clamp means on each of the opposite ends of said tubular axle shaft for circumferentially compressing those ends into frictional gripping engagement with the extending bosses of said pair of stub shafts; and (e) each of said pair of stub shafts having an oppositely axially extending trunnion for rotational journalling in the bearings of said blower structure.

18. An impeller assembly as claimed in claim 17 wherein said pair of stub shafts are each formed with an annular shoulder between the boss and the trunnion thereof.

19. An impeller assembly as claimed in claim 17 wherein said tubular axle shaft is formed of corrosion resistant tubing.

20. An impeller assembly as claimed in claim 17 wherein said blower wheel means comprises:

(a) a blower wheel having at least one end plate in which a centrally disposed hole and an endless axially offset peripheral ring are formed;

(b) a disc-plate in which a centrally disposed hole and an endless axially offset peripheral ring are formed;

(c) a hub sleeve mounted in the central holes of said blower wheel and said disc-plate for interconnection thereof in axially aligned juxtaposed relationship with the axially offset peripheral rings of said blower wheel and said disc-plate cooperatively defining an endless annular groove; and (d) an endless pulley band formed of a metallic strip in the endless annular groove defined by the axially offset peripheral rings of said blower wheel and said disc-plate, said pulley band having its opposite side edges in bearing engagement with the peripheral rings of said blower wheel and said disc-plate to fixedly hold said pulley band therebetween.

21. An impeller assembly as claimed in claim 20 and further comprising:

(a) said hub sleeve fixedly mounted in the central holes of said blower wheel and said disc-plate for fixed interconnection thereof in a predetermined spaced apart relationship;

(b) spacer means interposed between said blower wheel and said disc-plate adjacent the endless axially offset peripheral rings thereof to maintain the desired predetermined spaced relationship of said blower wheel and said disc-plate at the peripheries thereof; and (c) fastener means passing through the end plate of said blower wheel and through said disc-plate adjacent said spacer means to fixedly interconnect said blower wheel and said disc-plate adjacent the peripheral rings thereof.

22. An impeller assembly as claimed in claim 20 wherein said endless metallic pulley band is formed with an arcuate outwardly extending cross sectional configuration.

* * * * *